US009932190B2

(12) United States Patent
Wada

(10) Patent No.: US 9,932,190 B2
(45) Date of Patent: Apr. 3, 2018

(54) MEDIUM WINDER AND MEDIUM UNWINDING METHOD

(71) Applicant: Oki Data Corporation, Tokyo (JP)

(72) Inventor: Toshiyuki Wada, Tokyo (JP)

(73) Assignee: Oki Data Corporation, Tokyo (JP)

( * ) Notice: Subject to any disclaimer, the term of this patent is extended or adjusted under 35 U.S.C. 154(b) by 159 days.

(21) Appl. No.: 14/992,065

(22) Filed: Jan. 11, 2016

(65) Prior Publication Data

US 2016/0236890 A1 Aug. 18, 2016

(30) Foreign Application Priority Data

Feb. 12, 2015 (JP) ..... 2015-025545

(51) Int. Cl.
*B65H 23/198* (2006.01)

(52) U.S. Cl.
CPC ..... *B65H 23/198* (2013.01); *B65H 2404/143* (2013.01); *B65H 2511/112* (2013.01); *B65H 2513/11* (2013.01); *B65H 2701/1842* (2013.01); *B65H 2801/06* (2013.01)

(58) Field of Classification Search
CPC ..... B65H 23/198; B65H 2511/112; B65H 2513/11
See application file for complete search history.

(56) References Cited

U.S. PATENT DOCUMENTS 3,441,825 A * 4/1969 Dinger ..... B65H 23/042 242/413.6
4,159,808 A * 7/1979 Meihofer ..... B65H 23/1955 242/413.1
5,791,541 A * 8/1998 Jitsuishi ..... B65H 23/16 226/118.2
6,547,707 B2 * 4/2003 Cote ..... B65H 23/048 242/417.3
2005/0242224 A1 * 11/2005 Shiraishi ..... B65H 23/06 242/421.1
2008/0048060 A1 * 2/2008 Kessler ..... B65C 9/1803 242/417.1

FOREIGN PATENT DOCUMENTS

JP S63-051261 A 3/1988

* cited by examiner

*Primary Examiner* — Sang K Kim
(74) *Attorney, Agent, or Firm* — Metrolexis Law Group, PLLC

(57) ABSTRACT

A medium winder, includes: a winding roller that winds a medium discharged from an image formation apparatus into a roll shape; first and second rollers that guide the medium to the winding roller; a dancer roller provided between the first and second rollers in the medium conveyance direction and movable upwardly and downwardly while contacting from above the medium between the first and second rollers; a winding driver that rotates the winding roller; a detector that detects the dancer roller; a dancer roller position recognition portion that recognizes the position of the dancer roller based on a detection result by the detector; and a winding drive controller that controls the winding driver. In an operation of unwinding the medium, the winding drive controller moves the dancer roller up and down by reducing or increasing the unwinding velocity of the medium based on a position of the dancer roller.

6 Claims, 14 Drawing Sheets

MEDIUM WINDER AND MEDIUM UNWINDING METHOD

CROSS REFERENCE TO RELATED APPLICATIONS

This application claims priority based on 35 USC 119 from prior Japanese Patent Application No. 2015-025545 filed on Feb. 12, 2015, entitled "MEDIUM WINDER AND MEDIUM. UNWINDING METHOD WITH THE SAME", the entire contents of which are incorporated herein by reference.

BACKGROUND OF THE INVENTION

1. Field of the Invention

The disclosure relates to a medium winder and a medium unwinding method using the medium winder.

2. Description of Related Art

Heretofore, paper winders have been provided as medium winders for printers capable of printing on long paper from a web as a roll medium. Paper from a web that is printed and ejected from such a printer is wound by a paper winder as a medium winder.

In such a type of paper winder, the paper printed and ejected from the printer is wound around a winding roller. The paper winder includes a dancer roller. The dancer roller is moved up and down along a guide in accordance with an amount of sag generated in the paper so as to absorb the difference between the paper winding velocity in the paper winder and the paper conveyance velocity in the printer.

In the above-described printer, it is necessary to warm up a printing section at the start of the printing or cool down the printing section at the end of the printing. During the warming-up and cooling-down processes, unprinted paper is wastefully ejected from the printer and is wound around the winding roller. In order not to waste paper, the printer rotates the paper feed roller and the conveyance roller in reverse directions after the warming-up and cooling-down of the printing section so as to unwind the paper which is once wound around the winding roller in the paper winder.

In the process of unwinding the paper, the dancer roller also functions to absorb the difference between the paper unwinding velocity in the paper winder and the paper reverse conveyance velocity in the printer.

In the process of unwinding paper, the position of the dancer roller is detected in the paper winder. When the dancer roller reaches the upper end of the guide, a driving motor to rotate the winding roller, that is, a winding roller driving motor, is driven in the reverse direction to rotate the winding roller in reverse for unwinding the paper. When the dancer roller reaches the lower end of the guide, the winding roller driving motor is halted to stop the rotation of the winding roller, thus terminating the unwinding of paper (see Japanese Patent Application Publication No. S63-51261, for example).

SUMMARY OF THE INVENTION

In a conventional paper winder, paper is unwound by switching between activation and deactivation of the winding roller driving motor. Accordingly, tension applied to the paper significantly changes due to the weight of the dancer roller itself at the time of switching.

When the tension applied to the paper changes significantly, some structure of the conveyance mechanism of the printer paper may not unwind the paper in a good condition. In this case, the paper may be damaged by meandering.

An object of an embodiment of the invention is to provide a medium winder and a medium unwinding method which enable a medium to be rewound in a good condition.

An aspect of the invention is a medium winder that includes: a winding roller configured to wind a medium discharged from an image formation apparatus into a roll shape; first and second rollers configured to guide the medium to the winding roller; a dancer roller provided between the first and second rollers in a medium conveyance direction, and movable upwardly and downwardly while making contact from above with the medium between the first and second rollers; a winding driver configured to rotate the winding roller; a detector configured to detect the dancer roller; a dancer roller position recognition portion configured to recognize the position of the dancer roller based on an output of the detection by the detector; and a winding drive controller configured to control the winding driver. At an operation of unwinding the medium, the winding drive controller moves the dancer roller up and down by reducing or increasing the unwinding velocity of the medium based on a position of the dancer roller.

Thus according to this aspect, the winding motor controller, in the operation of unwinding the medium, reduces or increases the unwinding velocity of the medium in accordance with the position of the dancer roller to move the dancer roller up and down. Accordingly, it is unnecessary to start or stop driving the winding motor, and this prevents the tension of the medium from changing significantly.

As a result, the medium can be rewound in a good condition.

DETAILED DESCRIPTION OF EMBODIMENTS

Figure 1:
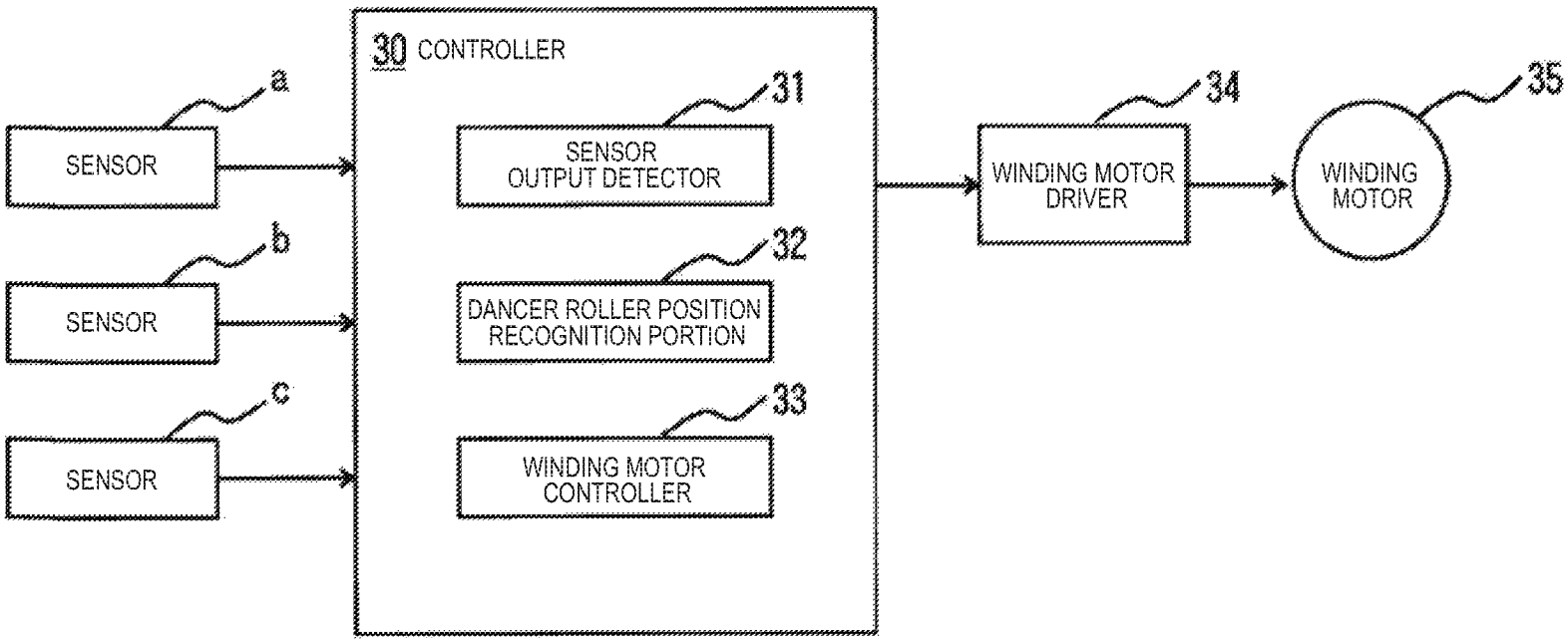
FIG. 1 is a control block diagram of a paper winder in an embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

The description is given of a paper winder as a medium winder and a printer as an image formation apparatus that incorporates the paper winder.

Figure 2:
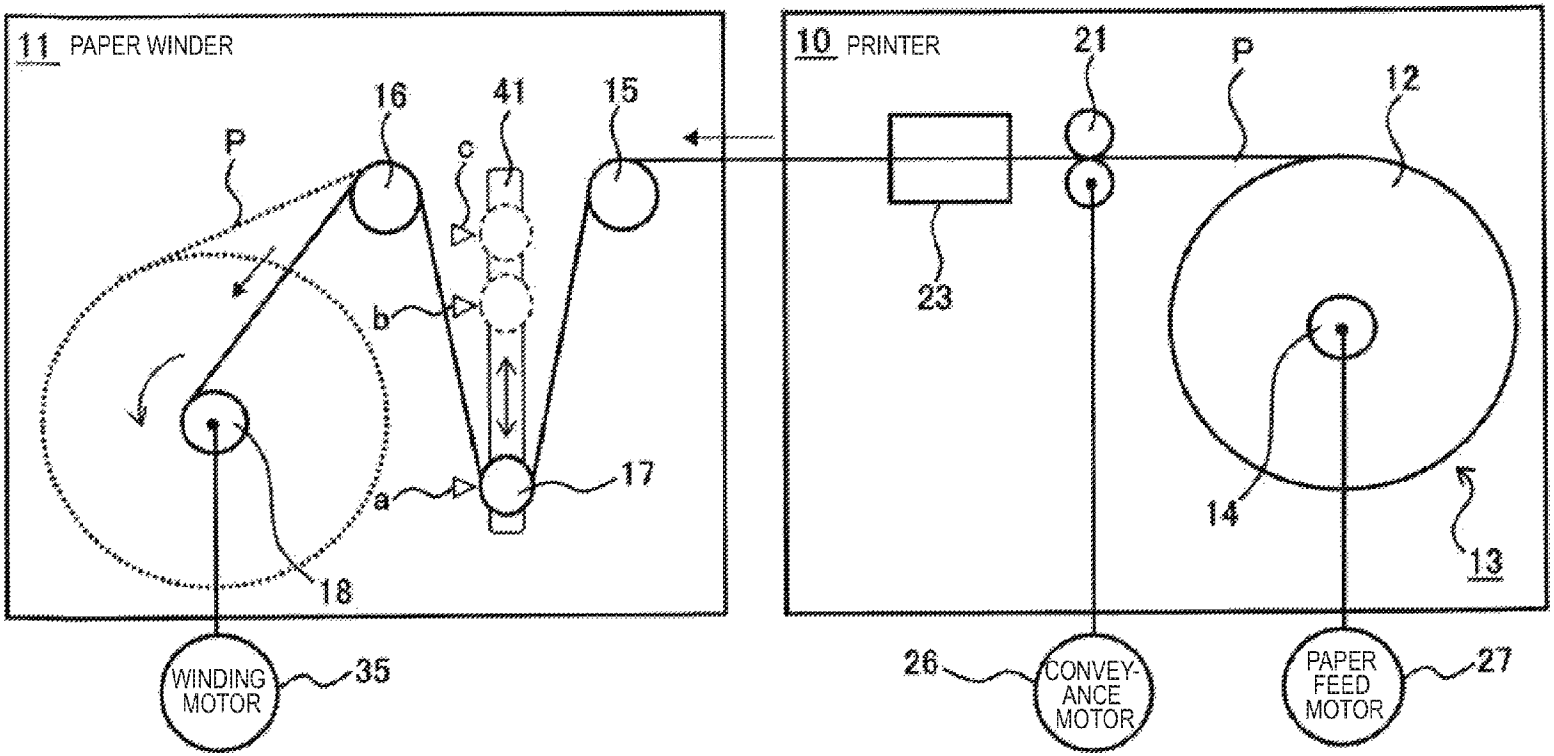
FIG. 2 is a conceptual diagram of the paper winder and a printer in the embodiment.

FIG. 2 is a conceptual diagram of the paper winder and printer in the embodiment of the invention.

In FIG. 2, reference numeral 10 denotes the printer, and reference numeral 11 denotes the paper winder connected to printer 10.

Printer 10 includes: feeder 13 in which web 12 as a roll medium is set; conveyance roller pair 21 as a conveyance mechanism configured to convey paper P as a long-length medium fed from feeder 13; printing section 23 configured to form an image on paper P for printing; and conveyance motor 26 as a conveyance driver which is configured to rotate the conveyance roller pair 21. Feeder 13 is provided with a feeding roller 14 configured to feed paper P from web 12; paper feeding motor 27 is a driver for feeding paper and is configured to rotate feeding roller 14; and the like.

In the embodiment, printing section 23 includes an electrophotographic printing mechanism. The electrophotographic printing mechanism of printing section 23 includes a photoreceptor drum as an image carrier; a charging roller as a charging device configured to uniformly charge the surface of the photoreceptor drum; an LED head as an exposure device configured to form an electrostatic latent image as a latent image on the photoreceptor drum with the surface charged; a development roller as a developer carrier configured to develop the electrostatic latent image to forma toner image as a developer image; a transfer roller as a transfer member configured to transfer the toner image onto paper; and a fixing unit as a fixing device configured to fix the toner image to the paper.

Paper winder 11 includes: idle rollers 15 and 16 as first and second rollers provided rotatably and configured to guide paper P ejected from printer 10; dancer roller 17 as an elevating roller which is provided rotatably so as to freely move up and down between idle rollers 15 and 16 in the conveyance direction of paper P and come into contact with the upper surface of paper P; winding roller 18 which is provided downstream of idle roller 16 in the conveyance direction of paper P and is configured to wind paper P ejected from printer 10 into a roll; and winding motor 35 as a winding driver which is configured to rotate winding roller 18.

Dancer roller 17 is configured to move up and down along guide 41 extended in the vertical direction and apply tension to paper P by the weight thereof.

The leading edge of paper P is attached to winding roller 18, and paper P is wound around winding roller 18 into a roll by winding motor 35 being driven.

Within the range in which dancer roller 17 moves, sensors a to c as plural detectors (three detectors in this embodiment) are arranged from the bottom to the top to detect the position of dancer roller 17. Winding motor 35 is driven by a later-described controller 30 (FIG. 1) in accordance with the position of dancer roller 17 which is detected by sensors a to c, whereby winding roller 18 is rotated. A first detector includes sensor b; a second detector, sensor c; and a third detector, sensor a. The distance between sensors b and c is shorter than the distance between sensors a and b.

Next, a description is given of the controller for paper winder 11.

FIG. 1 is a control block diagram of the paper winder in the embodiment of the invention.

In FIG. 1, reference characters a to c denote sensors; reference numeral 30 denotes a controller configured to entirely control paper winder 11 (FIG. 2); reference numeral 34 denotes a winding motor driver; and reference numeral 35 denotes a winding motor.

Controller 30 includes sensor output detector 31 as a detection output detector, dancer roller position recognition portion 32, and winding motor controller 33 as a winding drive controller.

Sensors a to c detect dancer roller 17 and send sensor outputs as detection outputs to controller 30. Sensor output detector 31 then reads the received sensor outputs. Each sensor output has on and off states. Sensor output detector 31 then determines whether each sensor a to c is on or off and sends the result of the determination to dancer roller position recognition portion 32. Based on the result of the determination by sensor output detector 31, dancer roller position recognition portion 32 recognizes the position of dancer roller 17 and sends the position information to winding motor controller 33.

Winding motor controller 33 controls winding motor driver 34 based on the position information sent to drive winding motor 35.

Next, a description is given of the operation of the winding of paper P in paper winder 11.

Figure 3:
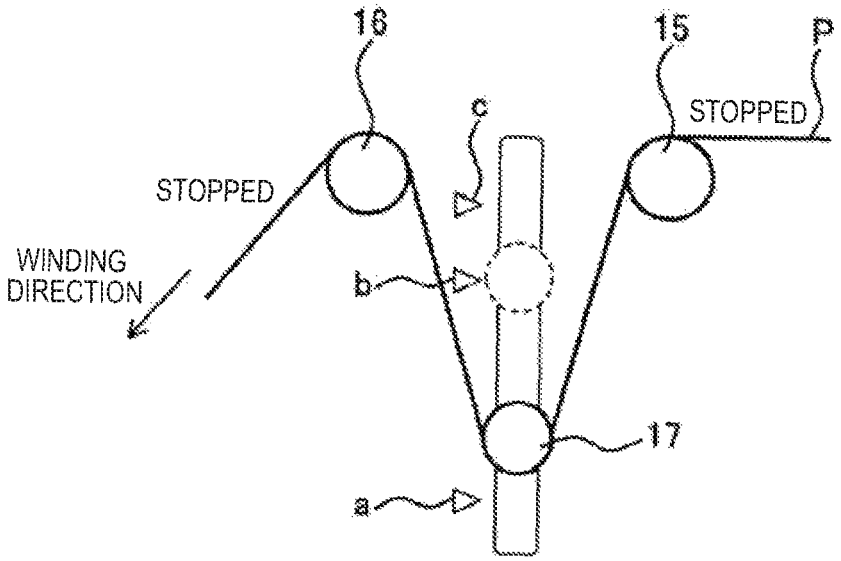
FIG. 3 is a first diagram for explaining a winding operation in the embodiment.
Figure 4:
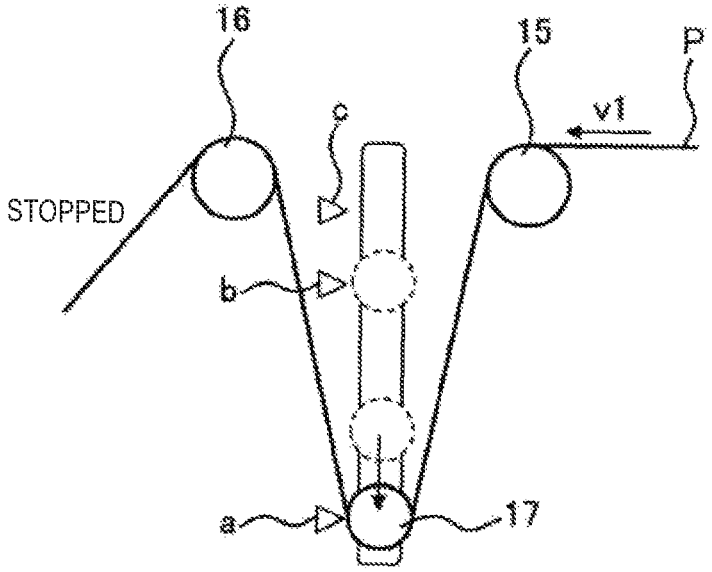
FIG. 4 is a second diagram for explaining the winding operation in the embodiment.
Figure 5:
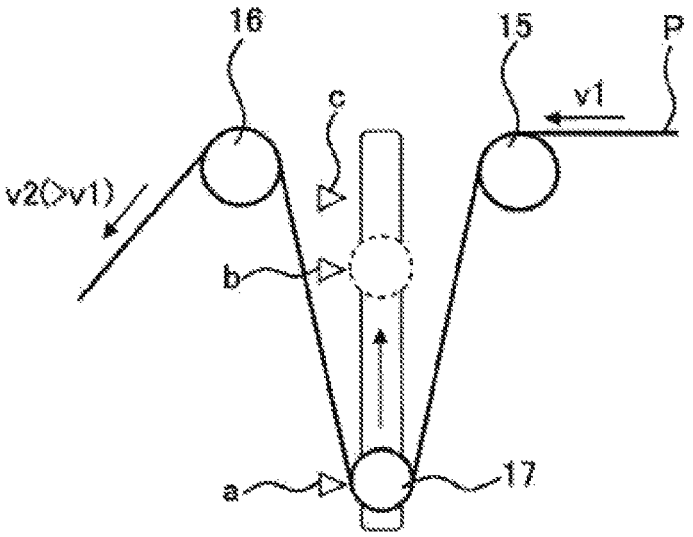
FIG. 5 is a third diagram for explaining the winding operation in the embodiment.
Figure 6:
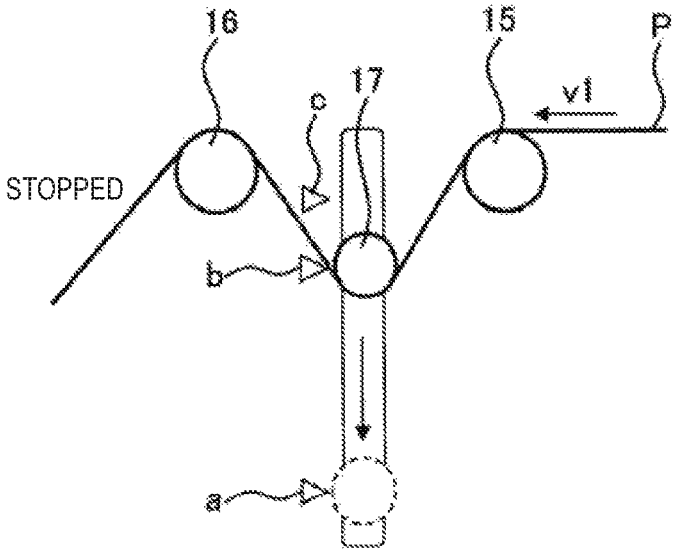
FIG. 6 is a fourth diagram for explaining the winding operation in the embodiment.

FIG. 3 is a first diagram for explaining a winding operation in the embodiment of the invention. FIG. 4 is a second diagram for explaining the winding operation in the embodiment of the invention. FIG. 5 is a third diagram for explaining the winding operation in the embodiment of the invention. FIG. 6 is a fourth diagram for explaining the winding operation in the embodiment of the invention.

In FIGS. 3 to 6, reference character P denotes paper; reference numerals 15 and 16 denote idle rollers; reference numeral 17 denotes dancer roller; and reference characters a to c denote sensors.

In the initial state of the operation of the winding of paper P in the paper winder 11, paper P is stopped on the upstream side (the printer 10 side) of dancer roller 17 in the winding direction of paper P and on the downstream side (the winding roller 18 side) of dancer roller 17, as illustrated in FIG. 3. At this time, dancer roller 17 is stopped at a stopping position between sensors a and b, and the rotation of idle rollers 15 and 16 is also stopped.

When printing starts in printer 10, paper feed motor 27 and conveyance motor 26 are driven to rotate paper feed roller 14 and conveyance roller pair 21. Paper P is therefore fed from paper roll 12 and is conveyed at conveyance velocity v1 on the upstream side of dancer roller 17 in the winding direction of paper P, as illustrated in FIG. 4.

In this process, dancer roller 17 is moved downward from the stopping position. Idle roller 15 is rotated while the rotation of idle roller 16 remains stopped.

When sensor a detects dancer roller 17 and sends the sensor output to controller 30, sensor output detector 31 reads the sensor output and determines that sensor a is "on", as described above. Sensor output detector 31 then sends the result of this determination to dancer roller position recognition portion 32. Dancer roller position recognition portion 32 recognizes the position of dancer roller 17, that is, the position information thereof based on the result of the determination by sensor output detector 31. Dancer roller position recognition portion 32 then sends the position information to winding motor controller 33. Winding motor controller 33 controls winding motor driver 34 based on the position information to drive winding motor 35.

Winding roller 18 is thereby rotated, so that paper P is wound around winding roller 18 at a winding velocity v2 on the downstream side of dancer roller 17 in the winding direction of paper P, as illustrated in FIG. 5.

In this process, the relationship between conveyance velocity v1 and winding velocity v2 of paper P is set to:

$v2>v1$

Dancer roller 17 is moved upward from the position of sensor a. Idle rollers 15 and 16 are rotated.

As illustrated in FIG. 6, when dancer roller 17 reaches the position of sensor b, sensor b detects dancer roller 17 and sends the sensor output to controller 30. Sensor output detector 31 then determines that sensor b is "on", and winding motor controller 33 stops driving winding motor 35. The rotation of winding roller 18 is thereby stopped, and paper P is stopped on the downstream side of dancer roller 17 in the winding direction of paper P.

In this process, dancer roller 17 is moved downward from the position of sensor b. The rotation of idle roller 16 remains stopped while idle roller 15 is rotated.

Dancer roller 17 is moved between sensors a and b in the operation of winding paper P as described above.

Next, a description is given of an operation of unwinding paper P in the paper winder 11.

Figure 7:
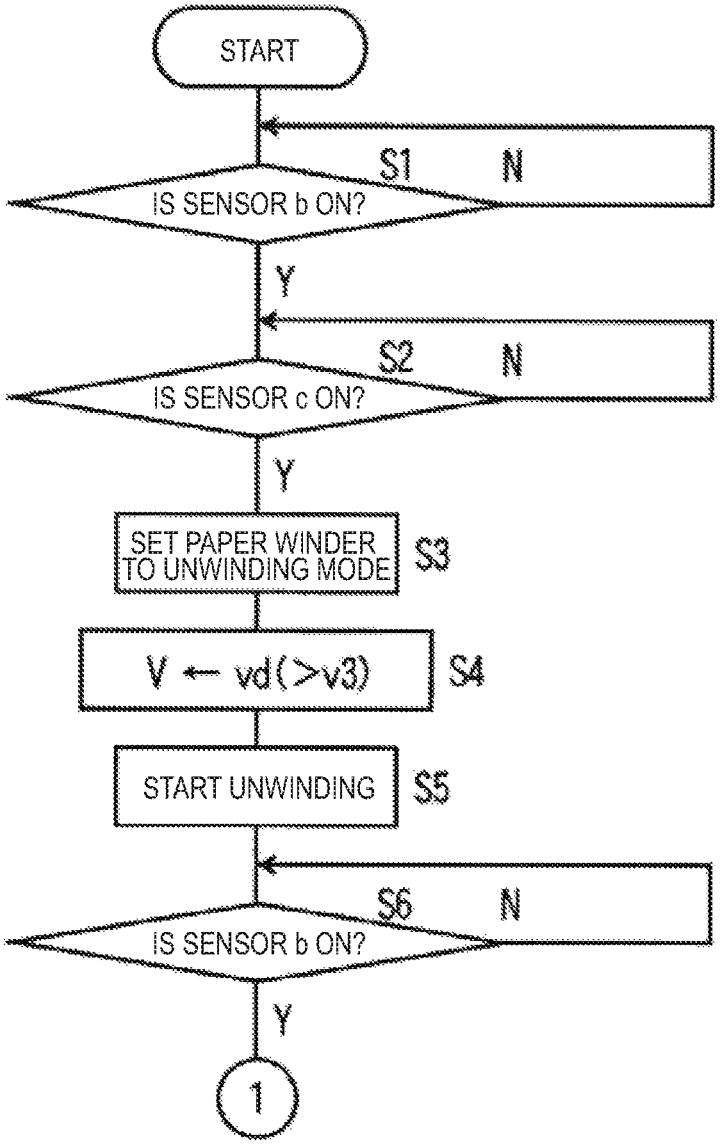
FIG. 7 is a first flowchart illustrating an unwinding operation in the embodiment.
Figure 8:
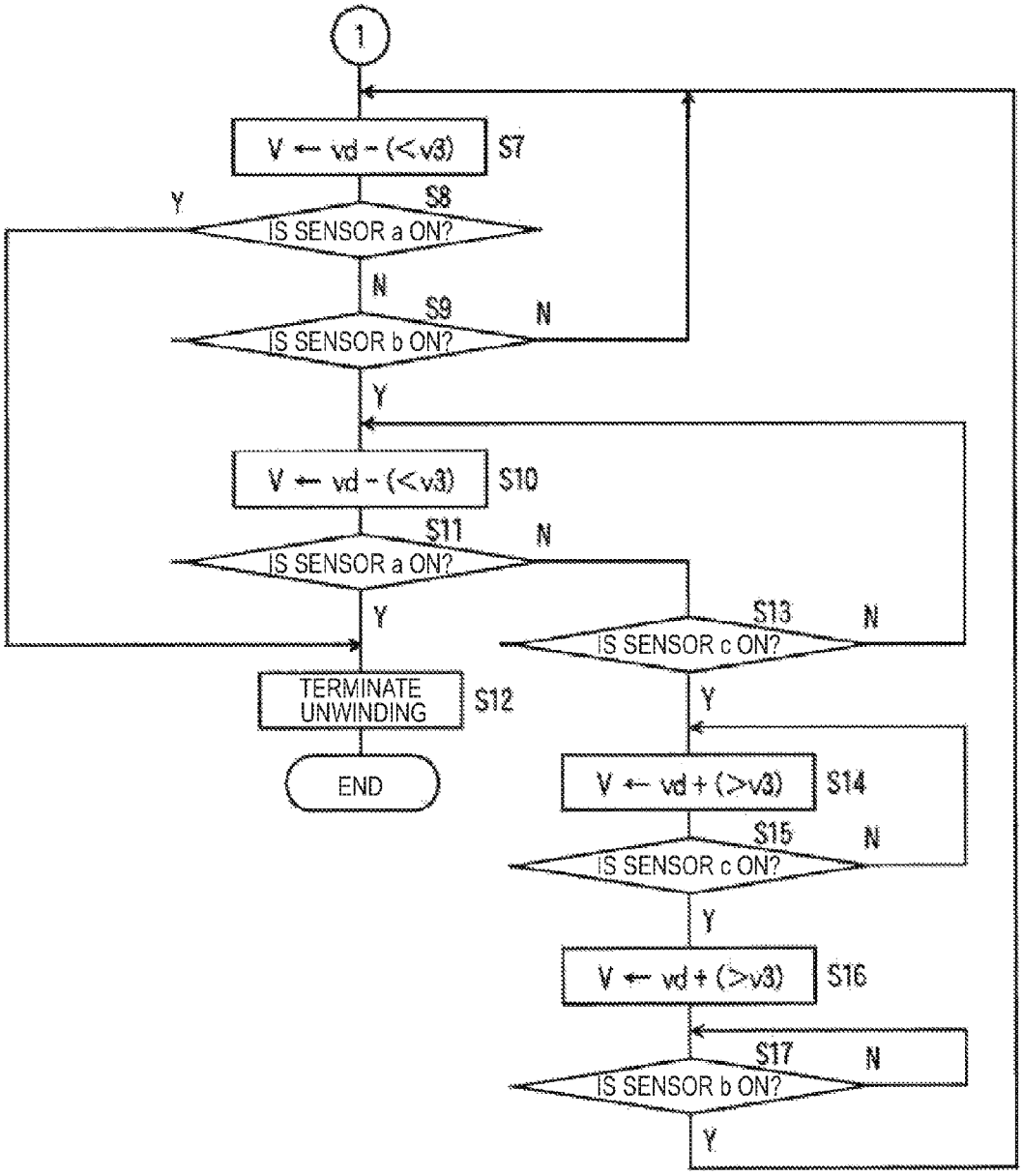
FIG. 8 is a second flowchart illustrating the unwinding operation in the embodiment.
Figure 9:
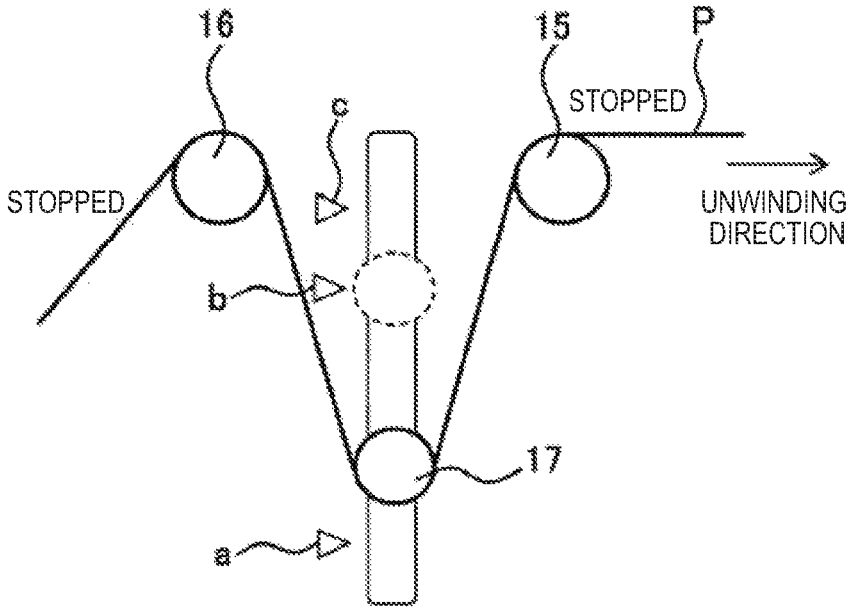
FIG. 9 is a first diagram for explaining the unwinding operation in the embodiment.
Figure 10:
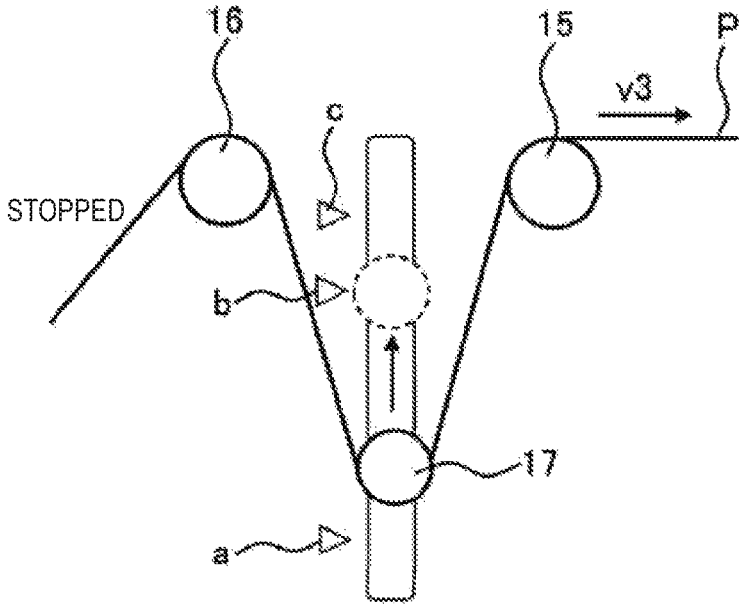
FIG. 10 is a second diagram for explaining the unwinding operation in the embodiment.
Figure 11:
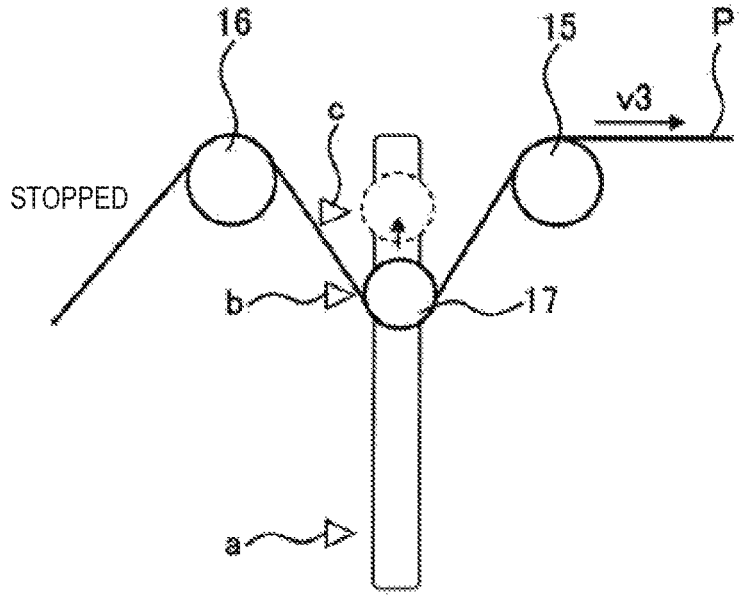
FIG. 11 is a third diagram for explaining the unwinding operation in the embodiment.
Figure 12:
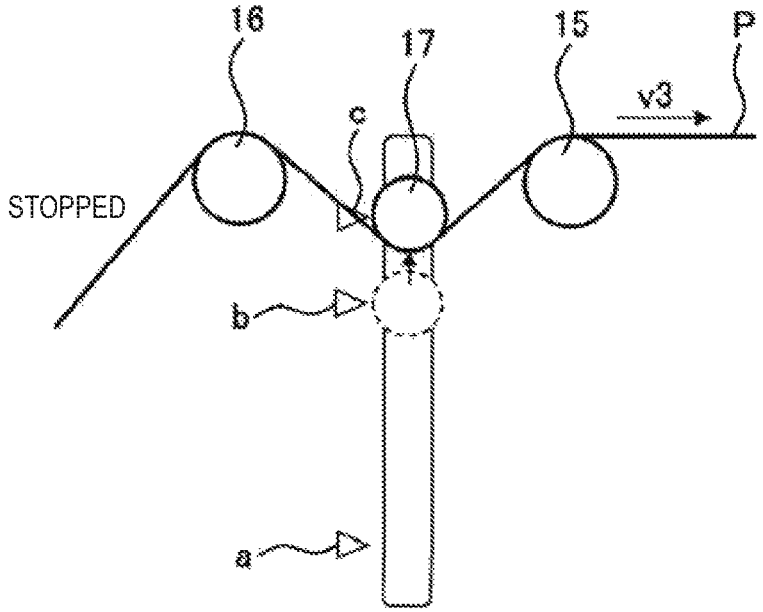
FIG. 12 is a fourth diagram for explaining the unwinding operation in the embodiment.
Figure 13:
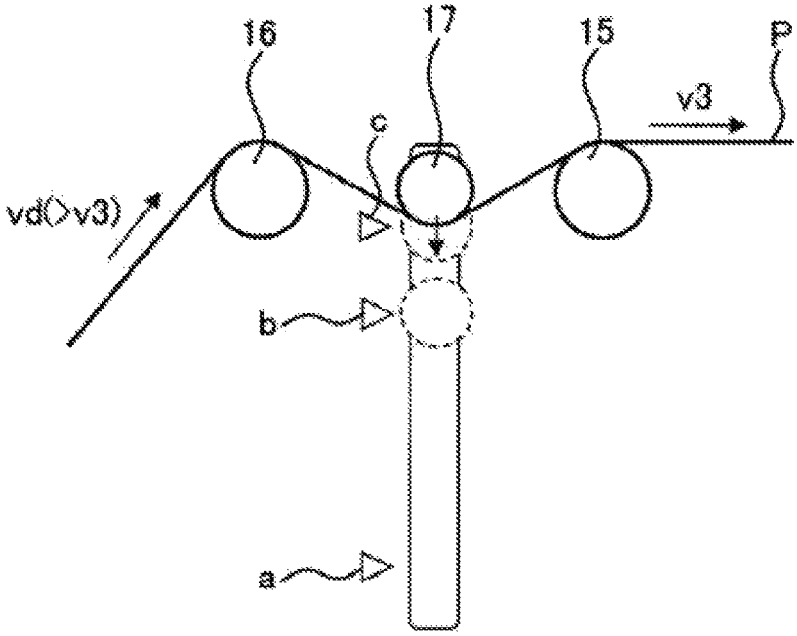
FIG. 13 is a fifth diagram for explaining the unwinding operation in the embodiment.
Figure 14:
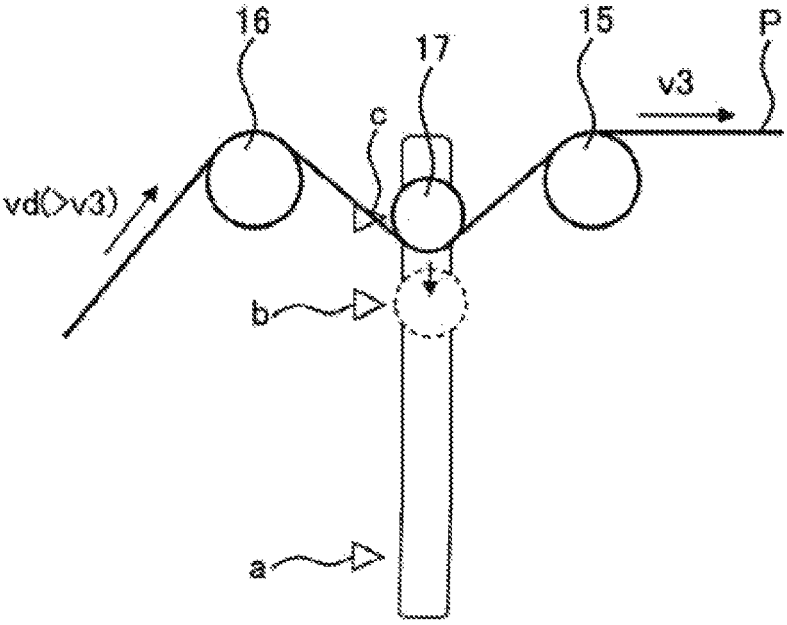
FIG. 14 is a sixth diagram for explaining the unwinding operation in the embodiment.
Figure 15:
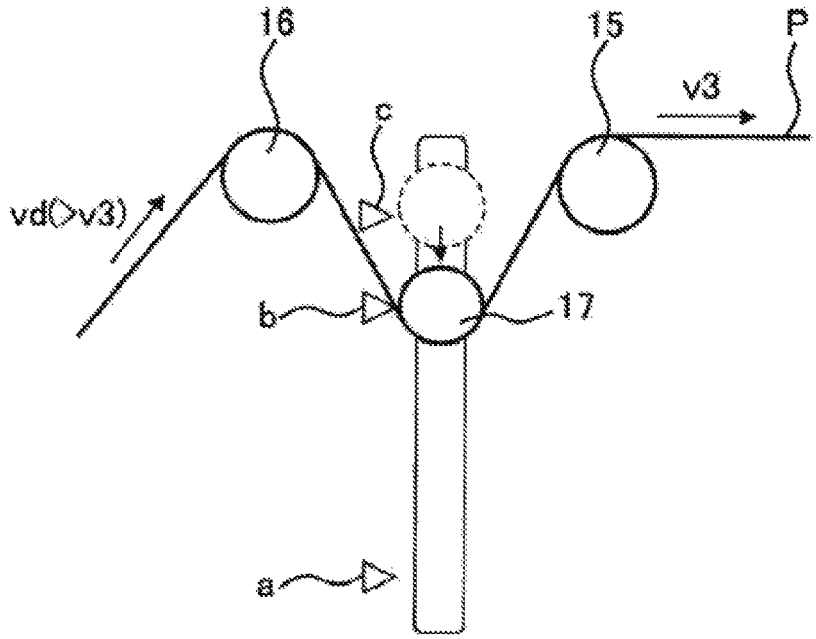
FIG. 15 is a seventh diagram for explaining the unwinding operation in the embodiment.
Figure 16:
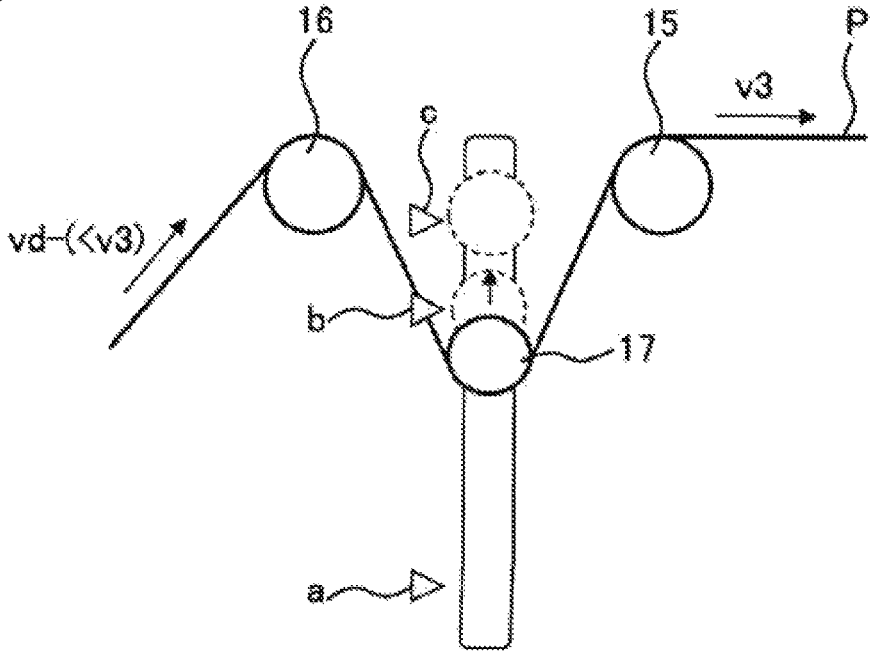
FIG. 16 is an eighth diagram for explaining the unwinding operation in the embodiment.
Figure 17:
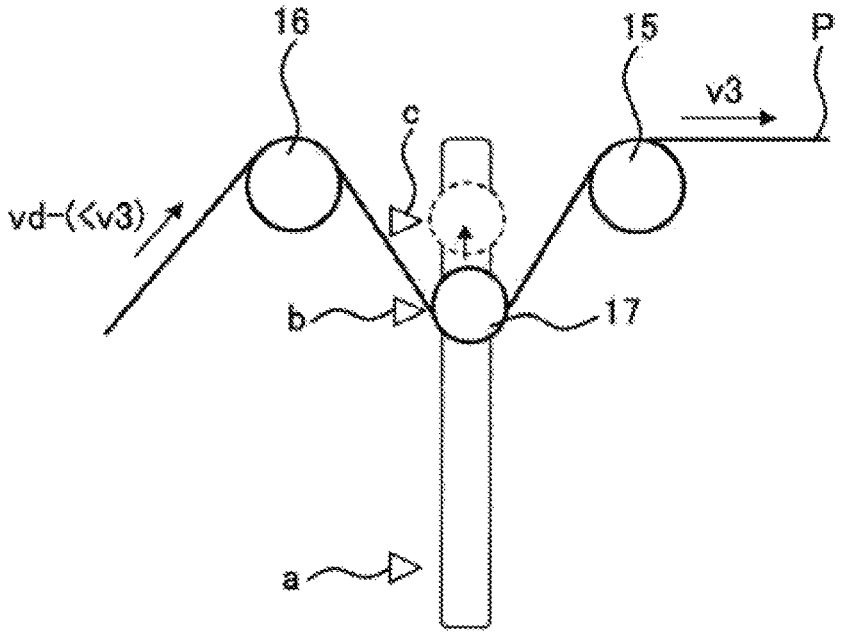
FIG. 17 is a ninth diagram for explaining the unwinding operation in the embodiment.
Figure 18:
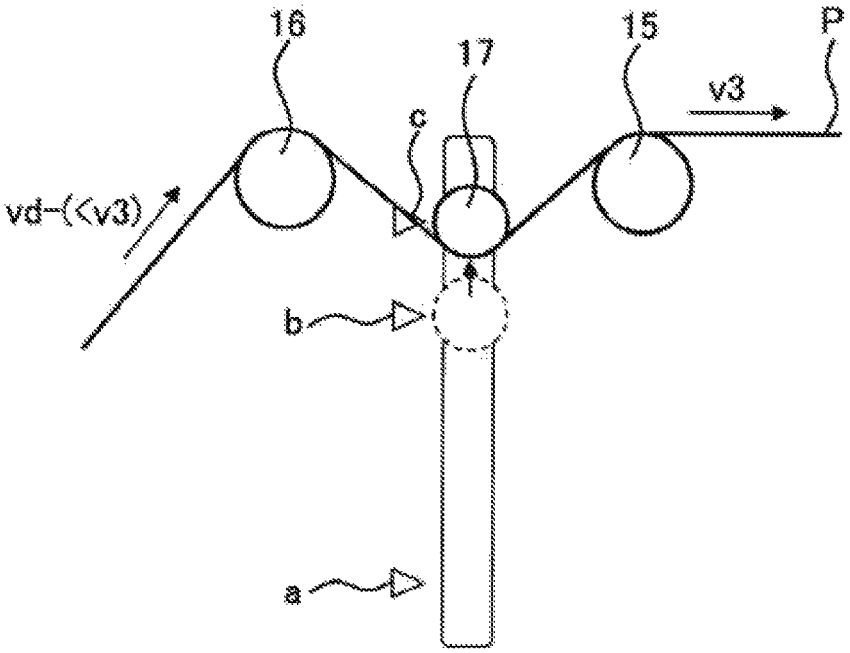
FIG. 18 is a tenth diagram for explaining the unwinding operation in the embodiment.
Figure 19:
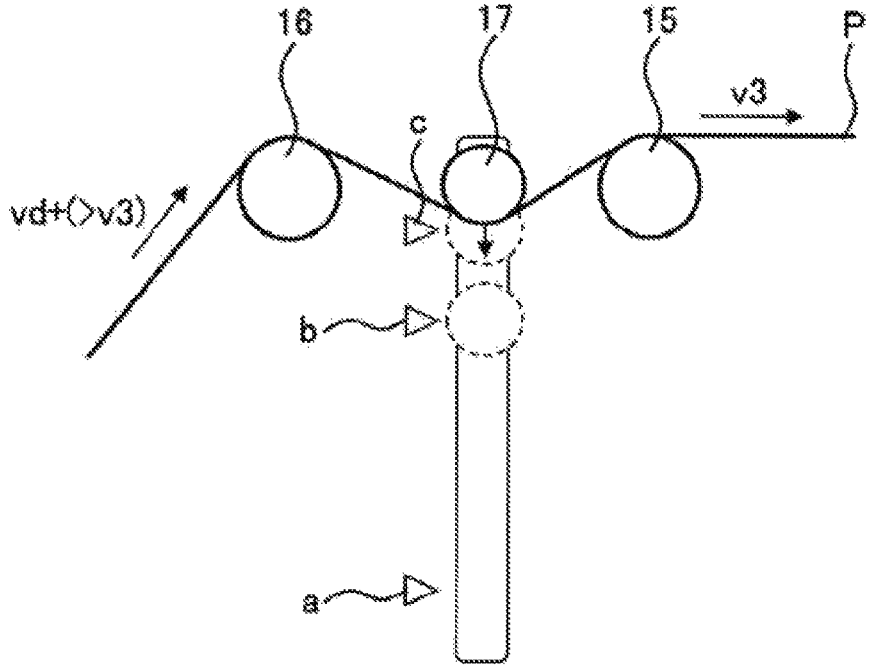
FIG. 19 is an eleventh diagram for explaining the unwinding operation in the embodiment.
Figure 20:
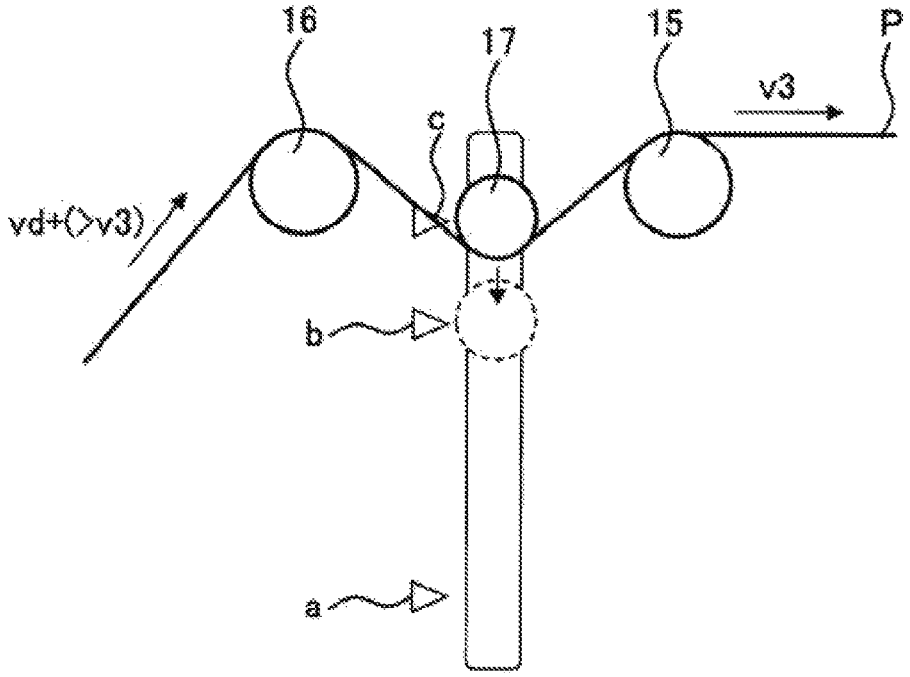
FIG. 20 is a twelfth diagram for explaining the unwinding operation in the embodiment.
Figure 21:
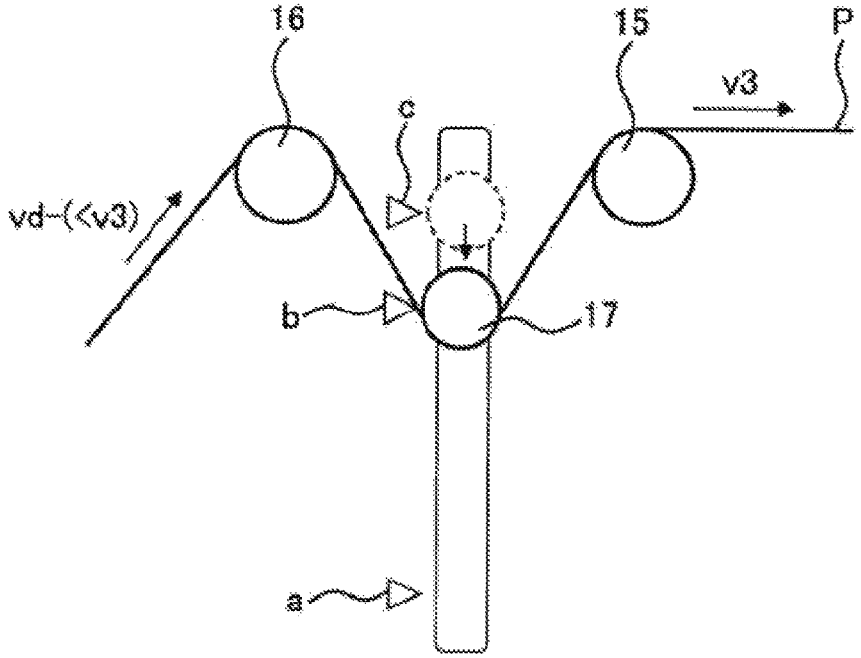
FIG. 21 is a thirteenth diagram for explaining the unwinding operation in the embodiment.
Figure 22:
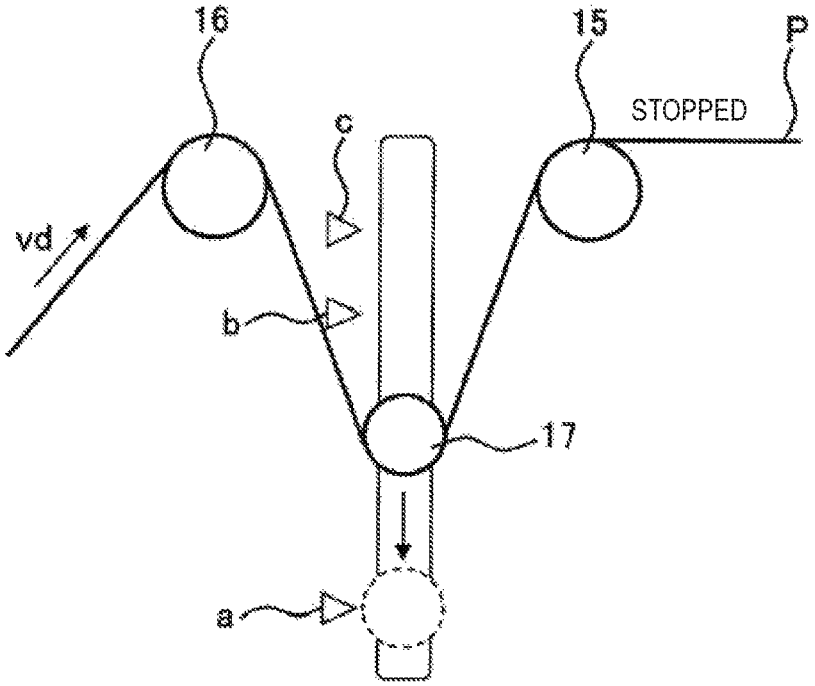
FIG. 22 is a fourteenth diagram for explaining the unwinding operation in the embodiment.
Figure 23:
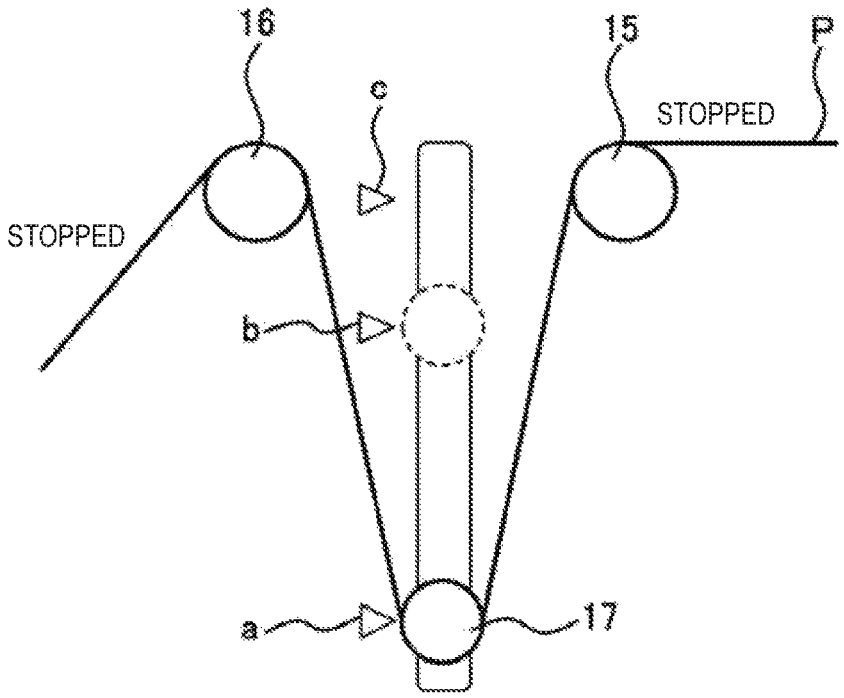
FIG. 23 is a fifteenth diagram for explaining the unwinding operation in the embodiment.

FIG. 7 is a first flowchart illustrating an unwinding operation in the embodiment of the invention. FIG. 8 is a second flowchart illustrating the unwinding operation in the embodiment of the invention. FIG. 9 is a first diagram for explaining the unwinding operation in the embodiment of the invention. FIG. 10 is a second diagram for explaining the unwinding operation in the embodiment of the invention. FIG. 11 is a third diagram for explaining the unwinding operation in the embodiment of the invention. FIG. 12 is a fourth diagram for explaining the unwinding operation in the embodiment of the invention. FIG. 13 is a fifth diagram for explaining the unwinding operation in the embodiment of the invention. FIG. 14 is a sixth diagram for explaining the unwinding operation in the embodiment of the invention. FIG. 15 is a seventh diagram for explaining the unwinding operation in the embodiment of the invention. FIG. 16 is an eighth diagram for explaining the unwinding operation in the embodiment of the invention. FIG. 17 is a ninth diagram for explaining the unwinding operation in the embodiment of the invention. FIG. 18 is a tenth diagram for explaining the unwinding operation in the embodiment of the invention. FIG. 19 is an eleventh diagram for explaining the unwinding operation in the embodiment of the invention. FIG. 20 is a twelfth diagram for explaining the unwinding operation in the embodiment of the invention. FIG. 21 is a thirteenth diagram for explaining the unwinding operation in the embodiment of the invention. FIG. 22 is a fourteenth diagram for explaining the unwinding operation in the embodiment of the invention. FIG. 23 is a fifteenth diagram for explaining the unwinding operation in the embodiment of the invention.

In the state where paper P is wound around winding roller 18 in a roll in the paper winder 11, that is, in the initial state of the operation of unwinding paper P, as illustrated in FIG. 9, paper P is stopped on the upstream side (winding roller 18 side) and on the downstream side (printer 10 side) of dancer roller 17 in the unwinding direction of paper P. In this process, dancer roller 17 is stopped at the stopping position between sensors a and b, and the rotation of idle rollers 15 and 16 is stopped.

In printer 10, paper feed motor 27 and conveyance motor 26 are driven in the reverse direction to rotate paper feed roller 14 and conveyance roller pair 21 in reverse. As illustrated in FIG. 10, paper P is conveyed at a reverse conveyance velocity v3 on the downstream side of dancer roller 17 in the unwinding direction of paper P.

In this process, dancer roller 17 is moved upward from the stopping position. The rotation of idle roller 16 remains stopped while the idle roller 15 is rotated.

As illustrated in FIG. 11, when dancer roller 17 reaches the position of sensor b, sensor b detects dancer roller 17 and sends the sensor output to controller 30. Sensor output detector 31 then determines that sensor b is "on". Subsequently, as illustrated in FIG. 12, when dancer roller 17 reaches the position of sensor c, sensor c detects dancer roller 17 and sends the sensor output to controller 30. Sensor output detector 31 then determines that sensor c is "on". Controller 30 thereby recognizes that paper P is conveyed in the reverse direction in printer 10 and sets paper winder 11 to an unwinding mode.

Next, dancer roller position recognition portion 32 recognizes that dancer roller 17 is located at the position of sensor c, and winding motor controller 33 then sets unwinding velocity V of paper P to initial unwinding velocity vd. The relationship between initial unwinding velocity vd and conveyance velocity v3 of paper P is set to:

$vd>v3$

Initial unwinding velocity vd is set in advance in accordance with conveyance velocity v3 of paper P.

Winding motor controller 33 controls winding motor driver 34 and drives winding motor 35 in the reverse direction to start the unwinding of paper P. At this time, dancer roller 17 is located at a position higher than sensor c, as illustrated in FIG. 13.

Winding roller 18 is thereby rotated in reverse, and paper P is unwound at an initial unwinding velocity vd in the upstream side of dancer roller 17 in the unwinding direction of paper P. Dancer roller 17 is therefore moved downward from the position higher than sensor c. Idle rollers 15 and 16 are rotated.

Subsequently, when dancer roller 17 reaches the position of sensor c as illustrated in FIG. 14 and then reaches the position of sensor b as illustrated in FIG. 15, sensor b detects dancer roller 17 and sends the sensor output to controller 30. Sensor output detector 31 determined that sensor b is "on". Winding motor controller 33 sets unwinding velocity V of paper P to the reduced unwinding velocity vd− as illustrated in FIG. 16, to reduce the unwinding velocity V of paper P. The relationship between reduced unwinding velocity vd− and conveyance velocity v3 of paper P is set to:

$vd-<v3$

Winding motor controller 33 controls winding motor driver 34 to drive winding motor 35 in the reverse direction and to rotate winding roller 18 in reverse continuously, so that paper P is unwound at reduced unwinding velocity vd− on the upstream side of dancer roller 17 in the unwinding direction of paper P.

At this time, dancer roller 17 is located at a position lower than sensor b. Dancer roller 17 is therefore moved upward from the position lower than sensor b. Idle rollers 15 and 16 are rotated.

When winding motor controller 33 sets unwinding velocity V of paper P to reduced unwinding velocity vd−, sensor output detector 31 determines whether sensor a is "on". When sensor a is "on", dancer roller 17 is determined to be at the position of sensor a. Winding motor controller 33 controls winding motor driver 34 to stop driving winding motor 35 and stop the rotation of winding roller 18, thus terminating the unwinding of paper P.

When dancer roller 17 is therefore moved upward from a position lower than sensor b as described above and reaches the position of sensor b as illustrated in FIG. 17, sensor b detects dancer roller 17 and sends the sensor output to controller 30. Sensor output detector 31 then determines that sensor b is "on", and winding motor controller 33 keeps unwinding velocity V of paper P set to reduced unwinding velocity vd−.

Subsequently, sensor output detector 31 determines whether sensor a is "on". When sensor a is "on", dancer roller 17 is determined to be at the position of sensor a, and winding motor controller 33 controls winding motor driver 34 to stop driving winding motor 35 and stop the rotation of winding roller 18, thus terminating the unwinding of paper P.

When dancer roller 17 then reaches the position of sensor c as illustrated in FIG. 18, sensor c detects dancer roller 17 and sends the sensor output to controller 30. Sensor output detector 31 then determines that sensor c is "on", and winding motor controller 33 sets unwinding velocity V of paper P to increased unwinding velocity vd+ to increase unwinding velocity V of paper P as illustrated in FIG. 19. The relationship between increased unwinding velocity vd+ and conveyance velocity v3 of paper P is set to:

Vd+>v3

Winding motor controller 33 controls winding motor driver 34 to drive winding motor 35 in the reverse direction and to rotate winding roller 18 in reverse continuously, so that paper P is unwound at increased unwinding velocity vd+ in the upstream side of dancer roller 17 in the unwinding direction of paper P.

Dancer roller 17 is located at a position higher than sensor c at this time. Dancer roller 17 is therefore moved downward from the position higher than sensor c. Idle rollers 15 and 16 are rotated.

When dancer roller 17 is moved downward from the position higher than sensor c to reach the position of sensor c as illustrated in FIG. 20, sensor c detects dancer roller 17 and sends the sensor output to controller 30. Sensor output detector 31 then determines that sensor c is "on", and winding motor controller 33 keeps unwinding velocity V of paper P set to increased unwinding velocity vd+.

When dancer roller 17 then reaches the position of sensor b as illustrated in FIG. 21, sensor b detects dancer roller 17 and sends the sensor output to the controller 30. Sensor output detector 31 then determines that sensor b is "on", and winding motor controller 33 sets unwinding velocity V of paper P again to reduced unwinding velocity vd−.

Paper P is therefore unwound at reduced unwinding velocity vd− again on the upstream side of dancer roller 17 in the unwinding direction of paper P, and dancer roller 17 is again moved upward from the position lower than sensor b.

Thereafter, the aforementioned unwinding operation is repeated until paper feed motor 27 and conveyance motor 26 in the reverse direction are halted in printer 10. To be specific, unwinding velocity V of paper P is alternately set to reduced and increased unwinding velocities vd− and vd+, so that unwinding velocity V of paper P is increased and reduced repeatedly.

When the operation of paper feed motor 27 and conveyance motor 26 in the reverse direction is halted in printer 10 and paper P is stopped on the downstream side of dancer roller 17 in the unwinding direction of paper P as illustrated in FIG. 22, winding motor controller 33 controls winding motor driver 34 to keep winding motor 35 operating in the reverse direction and continue the unwinding of paper P.

Winding roller 18 is rotated in reverse, and paper P is unwound at initial unwinding velocity vd on the upstream side of dancer roller 17 in the unwinding direction of paper P. When dancer roller 17 is then moved downward from the position of sensor b and reaches the position of sensor a as illustrated in FIG. 23, sensor a detects dancer roller 17 and sends the sensor output to controller 30. Sensor output detector 31 then determines that sensor a is "on", and winding motor controller 33 controls winding motor driver 34 to stop driving winding motor 35, thus terminating the unwinding of paper P.

At this time, paper P is stopped on the upstream side and downstream side of dancer roller 17 in the unwinding direction of paper P. Dancer roller 17 is stopped at the position of sensor a, and the rotation of idle rollers 15 and 16 is stopped.

In the operation of unwinding paper P according to this embodiment, winding motor controller 33 reduces or increases unwinding velocity V of paper P in accordance with the position of dancer roller 17 to move dancer roller 17 up and down. Accordingly, it is unnecessary to start or stop driving winding motor 35.

Accordingly, the weight of dancer roller 17 is not applied to paper P when dancer roller 17 is moved up and down, which prevents the tension of paper P from changing significantly.

In the process of unwinding paper P, paper P can be rewound in a good condition and can be prevented from being damaged by meandering.

Moreover, the distance between sensors b and c is shorter than the distance between a and b. Accordingly, the distance that dancer roller 17 is moved between the time to increase winding velocity V of paper P and the time to reduce winding velocity V can be short. This can reduce the inertia of dancer roller 17 being moved, further preventing the tension of paper P from changing significantly.

Since the distance that dancer roller 17 moves between the time to increase winding velocity V of paper P and the time to reduce winding velocity V can be made short, it is possible to reduce deceleration amount Δm, which is the difference between initial unwinding velocity Vd and reduced unwinding velocity vd−, and acceleration amount Δp, which is the difference between increased unwinding velocity vd+ and initial unwinding velocity Vd.

Next, a description is given of the flowchart.

Step S1: Sensor output detector 31 waits for sensor b to be turned "on".

Step S2: Sensor output detector 31 waits for sensor b to be turned "on".

Step S3: controller 30 sets paper winder 11 to the unwinding mode.

Step S4: Winding motor controller 33 sets unwinding velocity of paper P to initial unwinding velocity vd.

Step S5: Winding motor controller 33 starts the unwinding of paper P.

Step S6: Sensor output detector 31 waits for sensor b to be turned "on".

Step S7: Winding motor controller 33 sets unwinding velocity of paper P to reduced unwinding velocity vd−.

Step S8: Sensor output detector 31 determines whether sensor a is "on". When sensor a is "on", the procedure goes to step S12. When sensor a is not "on", the procedure goes to step S9.

Step S9: Sensor output detector 31 determines whether sensor b is "on". When sensor b is "on", the procedure goes to step S10. When sensor b is not "on", the procedure returns to step S7.

Step S10: Winding motor controller 33 keeps unwinding velocity of paper P set to reduced unwinding velocity vd−.

Step S11: Sensor output detector 31 determines whether sensor a is "on". When sensor a is "on", the procedure goes to step S12. When sensor a is not "on", the procedure goes to step S13.

Step S12: Winding motor controller 33 terminates the unwinding of paper P.

Step S13: Sensor output detector 31 determines whether sensor c is "on". When sensor c is "on", the procedure goes to step S14. When sensor c is not "on", the procedure returns to step S10.

Step S14: Winding motor controller 33 sets unwinding velocity of paper P to increased unwinding velocity vd+.

Step S15: Sensor output detector 31 determines whether sensor c is "on". When sensor c is "on", the procedure goes to step S16. When sensor c is not "on", the procedure returns to step S14.

Step S16: Winding motor controller 33 keeps unwinding velocity V of paper P set to increased unwinding velocity vd+.

Step S17: Sensor output detector 31 waits for sensor b to be turned "on".

In this embodiment, printer 10 is used as the image formation apparatus. However, the invention is applicable to copiers, facsimiles, and multifunction printers.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A medium winder, comprising:

a winding roller configured to wind a medium discharged from a feed roller of an image formation apparatus into a roll shape;

first and second rollers configured to guide the medium discharged from the feed roller to the winding roller;

a dancer roller provided between the first and second rollers, and movable upwardly and downwardly while contacting from above the medium between the first and second rollers when the dancer roller moves upwardly to a first position and downwardly to a second position;

a controller configured to control rotation of the winding roller; and a detector configured to detect the dancer roller, wherein the medium winder performs an operation of a winding in which the medium discharged from the feed roller is wound around the winding roller by rotating the winding roller and the feed roller in a first direction, and an operation of an unwinding in which the medium discharged from the winding roller is rewound around the feed roller by rotating the winding roller and the feed roller in a second direction opposite to the first direction, and when executing the operation of the unwinding, in a state in which the feed roller and the winding roller are stopped, a rotary drive of the feed roller in the second direction is driven at a first speed, the controller drives a rotary drive of the winding roller in the second direction at a second speed that is faster than the first speed after a position of the dancer roller is detected to be in the first position by the detector.

2. The medium winder according to claim 1, wherein in the operation of the unwinding, the feed roller is driven at the first speed for a predetermined time after the rotary drive of the winding roller in the second direction is driven at the second speed, the controller changes the second speed to a third speed that is slower than the first speed when the dancer roller is detected at the second position located below the first position.

3. The medium winder according to claim 2, wherein in the operation of the unwinding, the feed roller is stopped after being driven at the first speed for the predetermined time, the controller is stopped the rotary drive of the winding roller when the dancer roller is detected at a third position located below the second position after the feed roller is stopped.

4. The medium winder according to claim 3, wherein a distance between the first position and the second position is shorter than a distance between the second position and the third position.

5. The medium winder according to claim 3, wherein the detector includes a first sensor, a second sensor, and a third sensor, wherein the first sensor is disposed at the first position, the second sensor is disposed at the second position, the third sensor is disposed at the third position.

6. The medium winder according to claim 1, wherein the dancer roller is configured to move up and down along a guide extended in a vertical direction, and to apply tension to the medium by a weight of the dancer roller.

* * * * *